US009855567B2

(12) United States Patent
Wesselmeier

(10) Patent No.: US 9,855,567 B2
(45) Date of Patent: Jan. 2, 2018

(54) WATER NOZZLE

(71) Applicant: OASE GmbH, Hörstel-Riesenbeck (DE)

(72) Inventor: Reinhard Wesselmeier, Hörstel (DE)

(73) Assignee: OASE GmbH, Hörstel-Riesenbeck (DE)

( * ) Notice: Subject to any disclaimer, the term of this patent is extended or adjusted under 35 U.S.C. 154(b) by 0 days.

(21) Appl. No.: 15/369,925

(22) Filed: Dec. 6, 2016

(65) Prior Publication Data

US 2017/0157624 A1 Jun. 8, 2017

(30) Foreign Application Priority Data

Dec. 7, 2015 (DE) ..... 10 2015 121 232

(51) Int. Cl.
*B05B 1/12* (2006.01)

(52) U.S. Cl.
CPC ..... *B05B 1/12* (2013.01)

(58) Field of Classification Search
CPC .... B05B 1/12; B05B 1/06; B05B 7/12; B05B 1/265
See application file for complete search history.

(56) References Cited

U.S. PATENT DOCUMENTS 694,365 A * 3/1902 Garrison ..... B05B 1/308 239/448
1,864,647 A * 6/1932 Geer ..... E04F 21/12 239/424
2,389,642 A * 11/1945 Schellin ..... B05B 1/1681 239/441
2,692,800 A * 10/1954 Nichols ..... B05B 7/061 137/12
2,969,924 A * 1/1961 Jay ..... B05B 1/323 239/109
3,050,262 A * 8/1962 Curtis ..... A01M 13/00 239/400
3,423,028 A * 1/1969 Stupakis ..... B01F 5/0664 239/419.3
3,737,105 A * 6/1973 Arnold ..... B05B 1/06 239/423

(Continued)

FOREIGN PATENT DOCUMENTS

WO 2005/078289 8/2005
WO 2014/166563 10/2014

*Primary Examiner* — Christopher Kim
(74) *Attorney, Agent, or Firm* — Gudrun E. Huckett

(57) ABSTRACT

A water nozzle with a flow head is provided with at least two separate water supply devices that supply, in a controllable fashion, different water volume flows to the flow head. The flow head generates an annular jet from the different water volume flows. By controlling the water volume flows, alternatively a slim annular jet or a widened annular jet is generated by the flow head. A deflection element with a central outlet opening is provided, wherein the central outlet opening is arranged in a flow direction of the annular jet downstream of and spaced apart from the flow head. A deflection device surrounds the central outlet opening. A diameter of the central outlet opening is designed such that the slim annular jet is able to pass through the central outlet opening while the widened annular jet impacts on the deflection device surrounding the central outlet opening.

6 Claims, 4 Drawing Sheets

(56) References Cited

U.S. PATENT DOCUMENTS

| | | | | |
|---|---|---|---|---|
| 6,070,810 | A * | 6/2000 | Chen | B05B 1/005 239/436 |
| 8,297,529 | B2 * | 10/2012 | Smith | B05B 7/08 239/11 |
| 2006/0163385 | A1 * | 7/2006 | Link | B01F 5/0682 239/424 |
| 2009/0032611 | A1 | 2/2009 | Fulton et al. | |
| 2016/0082448 | A1 | 3/2016 | Wesselmeier | |

* cited by examiner

WATER NOZZLE

BACKGROUND OF THE INVENTION

The invention relates to a water nozzle comprising at least two separate water supply devices through which, in a controllable fashion, different water volume flows can be supplied, wherein the water volume flows are combined at a flow head to an annular jet. By controlling the volume flows, a slim jet or at least a widened jet can be alternatively generated. Such a water nozzle is disclosed in WO 2014/166563 A1 and comprises at least two separate water supply devices through which, independent of each other, different water volume flows are supplied to a flow head. At the flow head, the water volume flows are combined to an annular jet. Depending on which one of the volume flows is greater, a slim bundled annular jet or a more or less widened annular jet is produced.

In practice, for generating water fountain display effects, there is the need for water nozzles that can shut off the generated water jet abruptly. This is realized by mechanical shut-off devices, so-called shutters, that shut off the water supply within the nozzle device and temporarily prevent water from exiting.

WO 2005/078289 A1 discloses a different construction in which a water jet, by means of independently switchable air supply valves, can be deflected into different channels so that a similar effect can be generated.

Both devices are however limited with regard to the water jet display throw because the aforementioned devices require a very expensive and complex configuration for high water pressures; such a configuration moreover requires intensive maintenance and is prone to wear. The configuration of WO 2005/078289 furthermore is subject to physical limitations with regard to the employable water pressure.

SUMMARY OF THE INVENTION

The invention has the object to provide a water nozzle with shut-off function for the water jet that is constructively simplified but can be used even at high water pressures and is thus suitable for great display throws of the water jet.

This object is solved by a water nozzle that comprises a deflection element that comprises a central outlet opening that is arranged in the flow direction downstream of the flow head and is spaced apart from the flow head, wherein a diameter of the central outlet opening is designed such that it allows passage of the slim jet while a widened jet impacts on a deflection device that surrounds the central outlet opening.

As in WO 2014/166563 A1, first an annular jet is generated at the flow head from the at least two water volume flows that are supplied through separate water supply devices. By variation of the water volume flows, the annular jet is configured either as a slim jet substantially in bundled form or is widened in a funnel shape. The water nozzle according to the invention comprises a deflection element that comprises a central outlet opening arranged in the flow direction downstream of the flow head at a spacing to the flow head. The diameter of the central outlet opening is selected such that a slim jet can pass uninhibited through the central outlet opening while a widened jet impacts on a deflection device that is extending about the central outlet opening. By control or variation of the water volume flows, a slim annular jet can thus be changed suddenly to a widened jet so that no water jet exits from the central outlet opening anymore, i.e., is essentially cut off, because the widened jet cannot pass through the central outlet opening and is deflected by the deflection device.

Preferably, the deflection device comprises a central body with an outer diameter that increases in the flow direction, wherein the central body has at its center the central outlet opening. The increasing outer diameter forms impact walls and guiding walls that achieve a deflection of a widened water jet that is as force reduced as possible and thus also reduces rebound and splashing. This central element can be conically shaped in the lower area, like a bottle stopper.

Preferably, the water nozzle comprises a guide pipe for the annular jet and the guide pipe extends from the flow head to the central outlet opening. This prevents that water, rebounding from the deflection device or dripping down, or other external influences, such as wind, can affect the annular jet, in particular when the annular jet is embodied as a slim jet designed to pass through the central outlet opening.

The deflection element can preferably comprise a hood or can be substantially designed to be hood-shaped, wherein the hood is extending at a spacing about the flow head. The hood can be shaped as a cylindrical cup wherein the central outlet opening is located in the upper hood center or in the "cup bottom". The hood-shaped configuration deflects and returns rebounding and deflected water of the funnel-shaped widened jet to a rearward/lower area and, in this way, channels the water flows so that, in case of a cut-off/deflected jet, essentially no water flow is visible about the water outlet.

In a further preferred embodiment, the hood extends opposite to the flow direction past the flow head in a direction toward the water supply devices so that it surrounds the water supply devices partially. In this way, the deflected water jet is returned into an area which normally is not visible to the onlooker. Also, with this extended deflection the returning water is decelerated sufficiently so that no rebound turbulences occur. Such a configuration is particularly advantageous when the water nozzle is mounted by means of a holder in such a way that as few as possible of the parts of the water nozzle project from the top surface of a surrounding medium and are visible. When this top surface is a water surface, flow head and water outlet must be arranged above the water surface while the rearward end of the hood extends to a location below the water surface so that returning water of the widened fanned-out jet is guided to a location below the water surface and thus remains invisible to the onlooker. When the surrounding medium, on the other hand, is a gravel bed, the nozzle can be arranged such that only the water outlet projects past the surface of the gravel bed while the hood is submerged with its rearward end in the gravel bed. In this case, the hood must not be longer than the spacing between the flow head and the water outlet but must only cover the visible projecting area.

BRIEF DESCRIPTION OF THE DRAWING

Further advantages and details result from the dependent claims and an embodiment illustrated in the drawings which will be explained in the following.

DESCRIPTION OF PREFERRED EMBODIMENTS

Figure 1:
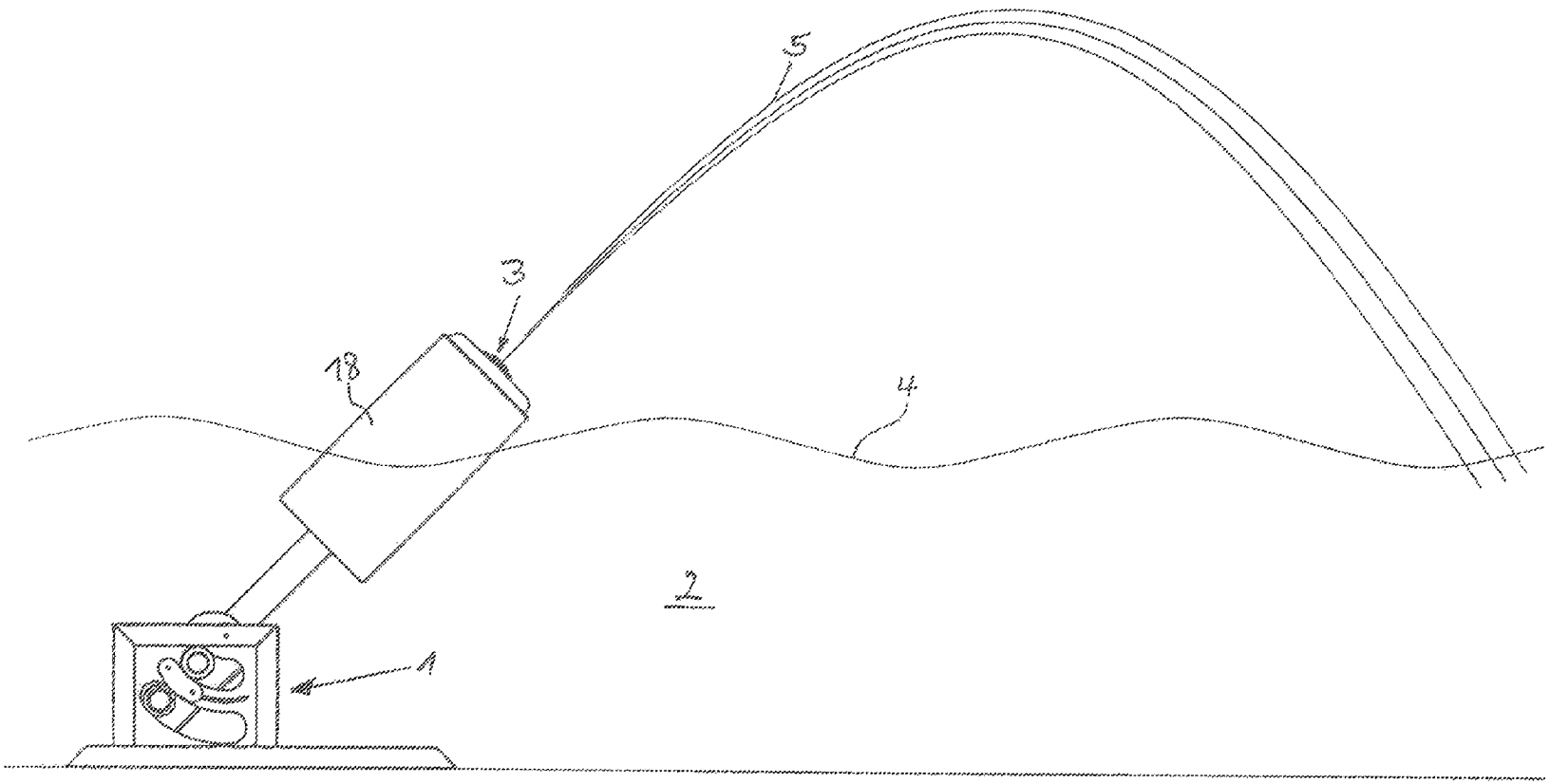
FIG. 1 shows a water nozzle according to the invention in use as it generates a parabolic water jet.

In the illustrated situation of use, the water nozzle illustrated in FIG. 1 is arranged by means of a holder 1 in a surrounding medium, here a water reservoir, in such a way that an outlet opening 3 of the water nozzle is projecting from the surface 4 of the water reservoir 2. The water nozzle generates in FIG. 1 a slim jet 5 with a great parabolic throw.

Figure 2:
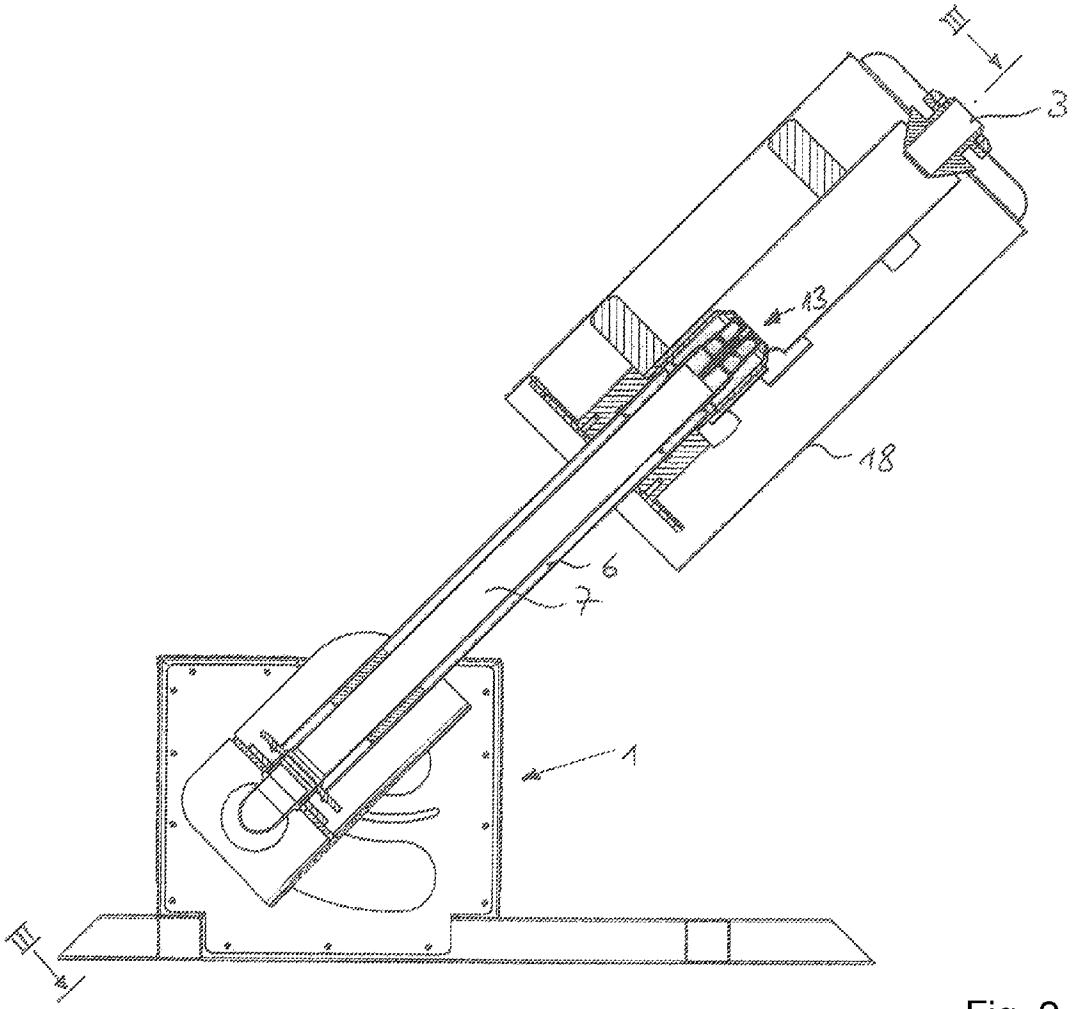
FIG. 2 shows a longitudinal section of the water nozzle of FIG. 1 without water volume flows being illustrated.

FIG. 2 shows the nozzle of FIG. 1 in section view but without water reservoir 2 and without water volume flows. The function of the water nozzle will be explained in connection with FIG. 3 and FIG. 4.

Figure 3:
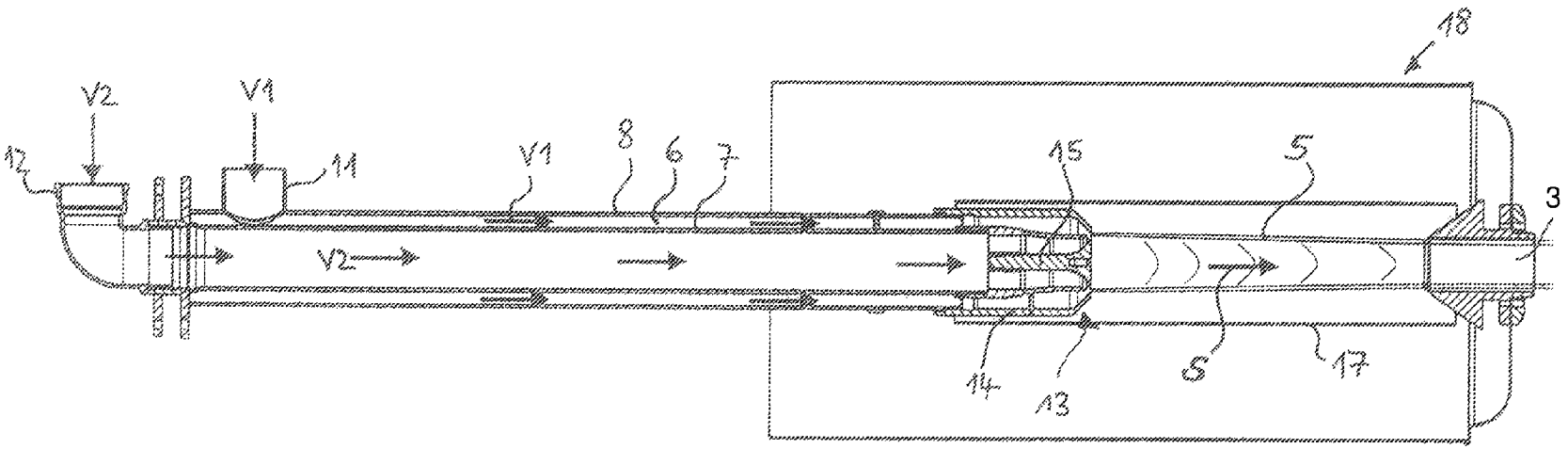
FIG. 3 shows a section in the direction III-III through the water nozzle of FIG. 2 without support but with illustrated water volume flows.
Figure 4:
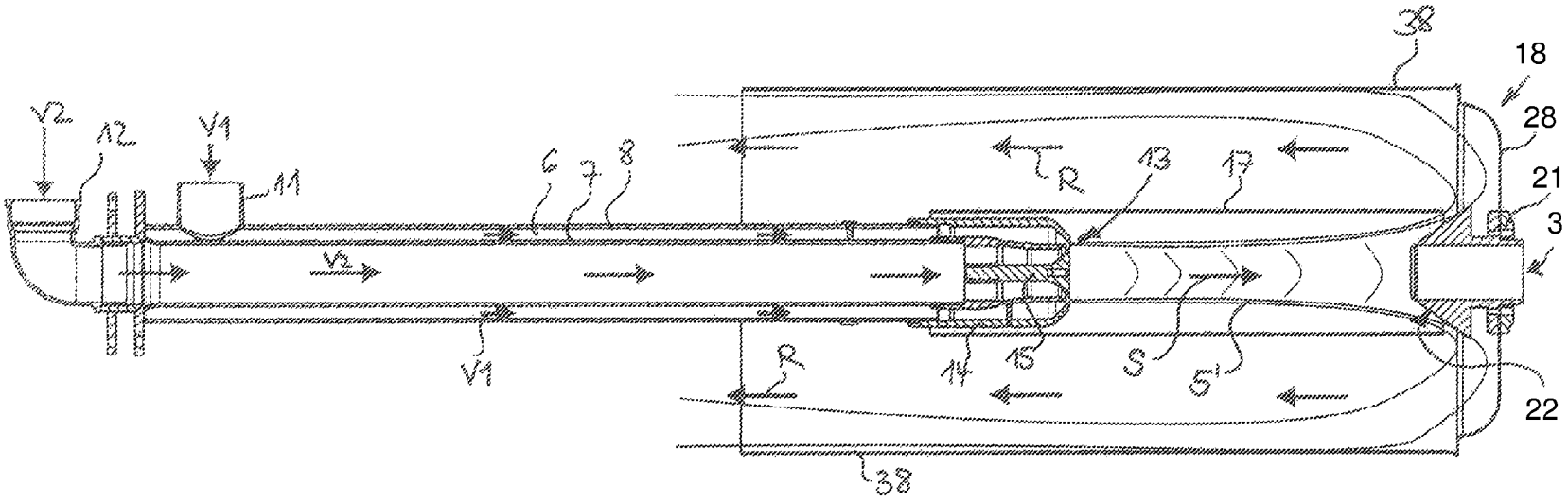
FIG. 4 shows the water nozzle of FIG. 3 with widened deflected water jet.

In the schematic illustrations of the functional principle of FIG. 3 and FIG. 4, the nozzle has a first connector 11 for a first pump, not illustrated. This pump pumps a water volume flow V1 into an annular water supply device 6 which is formed by an intermediate space between an inner pipe 7 and an outer pipe 8 of the nozzle. At the same time, a second pump, also not illustrated, pumps a water volume flow V2 through a second connector 12 into the second water supply device which is formed by the inner pipe 7.

At the leading end of the inner pipe 7 and of the outer pipe 8, a flow head 13 is provided which is substantially formed of an outer flow guiding device 14 and an inner flow guiding device 15. Both flow guiding devices 14, 15 are preferably adjustable and combine the water volume flows V1 and V2 at the exit of the flow head 13 to a sharply delimited annular jet 5. The adjustability of the flow guiding devices 14, 15 serves in this context for adjusting the annular jet 5. The annular jet 5 passes without contact through the guide pipe 17 to a deflection element 18 which is designed as a hood in the illustrated embodiment. The deflection element 18 comprises the central outlet opening 3, which is arranged in flow direction S downstream of the flow head 13 and is spaced apart from the flow head 13. Through the central outlet opening 3 the annular jet 5 can pass unhindered in FIG. 3.

FIG. 4 shows an alternative operating state of the water nozzle. The volume flow V2 was increased relative to volume flow V1 or the volume flow V1 was reduced relative to volume flow V2. Therefore, a funnel-shaped widened annular jet 5' is formed at the flow head 13. The annular jet 5' of water cannot pass the outlet opening 3 because of its widened shape. The widened annular jet 5' is instead deflected by means of a deflection device which is part of the deflection element 18 or, in this case, the hood. Thus, the annular jet 5' of water impacts on the impact and guiding walls 22 of a central body 21 of the deflection device and from there flows back in the direction of arrows R, possibly with further deflection by means of the closed end face 28 and the sidewalls 38 of the hood 18.

In the preferred embodiment, the hood 18 extends in a direction opposite to the flow direction S past the flow head 13. FIG. 1 shows that in this way in particular a return of the water return flow R to a location below the surface 4 of the surrounding medium (water reservoir 2) is realized.

By modulation of the volume flows V1 and V2 between the operating states of FIG. 3 and FIG. 4, the widened annular jet 5' shown in FIG. 4 can be generated by increase of the volume flow V2 or by reduction of the volume flow V1 relative to the volume flows of FIG. 3. This widened annular jet 5' cannot exit from the central outlet opening 3; therefore, the annular jet 5 appears to be cut off to the onlooker.

The water nozzle according to the invention can be operated at high water pressures so that great display heights and display throws of the water jet 5 can be produced. Also, by variation of the volume flows V1 and V2, additional effects are possible, for example, a variation of the display throw or generation of a slightly wavy jet. For this purpose, in particular pumps are suitable whose rotary speed can be electronically controlled.

The specification incorporates by reference the entire disclosure of German priority document 10 2015 121 232.3 having a filing date of Dec. 7, 2015.

While specific embodiments of the invention have been shown and described in detail to illustrate the inventive principles, it will be understood that the invention may be embodied otherwise without departing from such principles.

What is claimed is:

1. A water nozzle comprising:

a flow head;

at least two separate water supply devices configured to supply, in a controllable fashion, different water volume flows to the flow head, wherein the flow head is configured to generate an annular jet from the different water volume flows and wherein, by controlling the water volume flows, alternatively a slim annular jet or an at least somewhat widened annular jet is generated by the flow head;

a deflection element comprising a central outlet opening, wherein the central outlet opening is arranged in a flow direction of the annular jet downstream of the flow head and is spaced apart from the flow head;

a deflection device surrounding the central outlet opening;

wherein a diameter of the central outlet opening is designed such that the slim annular jet is able to pass through the central outlet opening while the widened annular jet impacts on the deflection device surrounding the central outlet opening.

2. The water nozzle according to claim 1, further comprising a guide pipe extending from the flow head to the central outlet opening, wherein the annular jet passes through the guide pipe.

3. The water nozzle according to claim 1, wherein the deflection element comprises a hood surrounding at a spacing the flow head.

4. The water nozzle according to claim 3, wherein the hood extends in a direction opposite to the flow direction past the flow head toward the at least two water supply devices and partially surrounds the at least two water supply devices.

5. The water nozzle according to claim 4, further comprising a holder configured to mount the water nozzle such that the central outlet opening projects from a surface of a surrounding medium that covers the holder, wherein the rearward open end of the hood remote from the central outlet opening is extending to a point below the surface of the surrounding medium.

6. The water nozzle according to claim 5, wherein the flow head projects from the surface of the surrounding medium that covers the holder.

* * * * *